US007927432B2

(12) United States Patent
Jørgensen et al.

(10) Patent No.: US 7,927,432 B2
(45) Date of Patent: Apr. 19, 2011

(54) CLEANING HEAD

(75) Inventors: Hans Erik Jørgensen, Ishøj (DK); Leon Hjorslev, Ishøj (DK)

(73) Assignee: Alfa Laval Tank Equipment A/S, Ishoj (DK)

( * ) Notice: Subject to any disclaimer, the term of this patent is extended or adjusted under 35 U.S.C. 154(b) by 224 days.

(21) Appl. No.: 12/279,821

(22) PCT Filed: Nov. 20, 2006

(86) PCT No.: PCT/DK2006/000643

§ 371 (c)(1),
(2), (4) Date: Dec. 17, 2008

(87) PCT Pub. No.: WO2007/104307

PCT Pub. Date: Sep. 20, 2007

(65) Prior Publication Data

US 2009/0320890 A1 Dec. 31, 2009

(30) Foreign Application Priority Data

Mar. 13, 2006 (DK) ..... 2006 00349

(51) Int. Cl.
*B08B 3/02* (2006.01)

(52) U.S. Cl. ..... 134/166 R; 134/167 R; 134/198

(58) Field of Classification Search ..... 134/166 R, 134/167 R, 198

See application file for complete search history.

(56) References Cited

U.S. PATENT DOCUMENTS

| | | | | | |
|---|---|---|---|---|---|
| 1,519,417 | A | * | 12/1924 | Payne | 192/84.2 |
| 2,488,827 | A | * | 11/1949 | Pensabene | 310/105 |
| 3,910,211 | A | * | 10/1975 | Kubokura | 112/275 |
| 5,092,523 | A | * | 3/1992 | Rucker et al. | 239/240 |
| 5,350,283 | A | * | 9/1994 | Nakazeki et al. | 417/423.7 |
| 5,640,983 | A | | 6/1997 | Sherman, Jr. | |
| 5,673,717 | A | * | 10/1997 | Jinback | 134/167 R |
| 5,871,023 | A | | 2/1999 | Sherman, Jr. | |
| 6,208,053 | B1 | * | 3/2001 | Scott | 310/105 |
| 6,951,269 | B2 | * | 10/2005 | Schneider et al. | 192/18 B |

FOREIGN PATENT DOCUMENTS

| | | | |
|---|---|---|---|
| DE | 39 05 640 | * | 8/1989 |
| JP | 02299457 | A | 12/1997 |
| JP | 2005-233326 | A | 9/2005 |

OTHER PUBLICATIONS

International Search Report.

* cited by examiner

*Primary Examiner* — Frankie L Stinson
(74) *Attorney, Agent, or Firm* — William J. Sapone; Coleman Sudol Sapone P.C.

(57) ABSTRACT

When, according to the invention, a cleaning head is provided with a hysteresis coupling (9, 11) between the turbine (3) and the gear in the gear housing (13), the gear will remain separated from the turbine and not be subjected to liquid impact. The hysteresis coupling (9, 11) may be adjusted using electromagnets (9) as an inductor, which allows control/regulation of the rotating movements of the cleaning head to achieve the best possible cleaning pattern.

5 Claims, 1 Drawing Sheet

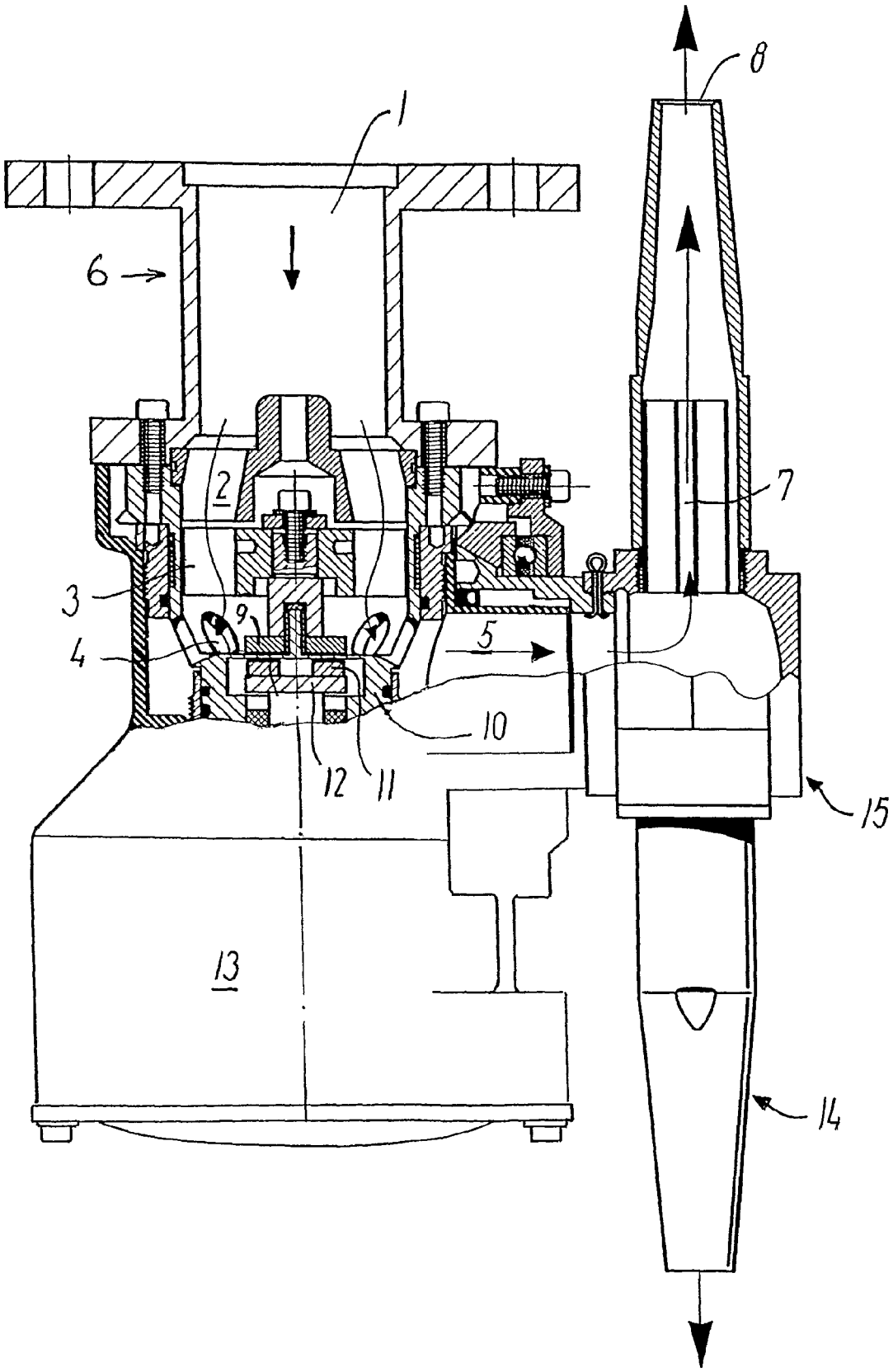
1
2
3
4
5
6
7
8
9
10
11
12
13
14
15

CLEANING HEAD

THE PRIOR ART

The invention relates to a cleaning head, in particular for mounting inside a tank, said head being provided with a turbine which is driven by a source of pressure liquid for causing rotation of a gear, which in turn causes the gear housing and a hub, mounted thereon and having nozzles, to rotate, said liquid being conveyed from the turbine and to the nozzles in operation, said gear housing being mounted on a stationary mounting part so that the liquid from the turbine bypasses the gear housing and flows to the nozzles, and that the rotation of the turbine is transferred to the input shaft of the gear by means of a magnetic coupling having coupling parts, the driving coupling part of which being disposed outside the gear housing, and the driven coupling part of which being disposed inside the gear housing.

Cleaning equipment of this type is used in particular for the cleaning of tanks, it being possible to eject cleaning jets by means of nozzles and pressure liquid which will clean the tank in an effective manner by their combined turning and rotation.

The rotation produced by the turbine is transferred to a gear which partly turns the housing, partly rotates the rotary hub with the nozzles. Hereby, the liquid is passed through the gear and further out to the nozzles.

If there is a need for separating the liquid part from the gear, transfer of the rotation of the turbine to the gear may take place via a magnetic coupling, as the driving magnetic part is disposed outside the housing, while the gear is incorporated in a closed housing separated from the liquid, and with the driven magnetic part connected with the input shaft of the gear.

Such a cleaning head for a tank cleaning system is known from U.S. Pat. No. 5,871,023, in which it may be seen in FIG. 2 that the impeller 38 in the liquid channel drives a disc-shaped magnetic part 40 , which is disposed outside the gear housing, and which is coupled magnetically to another disc-shaped magnetic part 58, which is located "dry" inside the gear housing. It is described in column 4, lines 33-38 and column, lines 4-10 that each of the magnetic parts consists of four uniform magnets which are embedded in a disc of stainless steel, and that the magnets are of materials which are typically used for the manufacture of permanent magnets.

In practice, however, it is difficult to make such a magnetic coupling having permanent magnets on the driving side as well as the driven side work satisfactorily in connection with cleaning heads for tanks.

The problem of this known coupling head is the risk of missing magnetic coupling-together and thus missing transfer of the rotary movement, just as there is a great risk of "slip" in the coupling. The latter is primarily due to the high speed of rotation which is imparted to the turbine at start, which results in difficulties in capturing the field because of the high speed of rotation and the stationary, driven part.

Such a situation occurs when the starting torque or the load torque exceeds the maximum torque of the coupling. The coupling slips in a jerky or shaking manner, because the magnetic forces are interrupted between the poles disposed opposite each other and can then only transfer very small torques. Therefore, it is necessary to close down the system completely in order to avoid damage to bearings and other parts in the system.

Couplings of this type having permanent magnets are also called synchronous couplings for the same reason, precisely because it is a requirement for a satisfactory function that the coupling parts move together. In other words, it is necessary to dimension the coupling such that its maximum torque is considerably greater than the starting torque if the system is to be able to start. However, the situation might always occur that errors or impurities in the liquid flow may cause the load torque to exceed the maximum torque that can be transferred, which causes slip in the coupling. Under normal conditions of operation, these couplings operate with a fixed slip angle which is determined in the dimensioning.

THE OBJECT OF THE INVENTION

The object of the invention is to remedy these defects and drawbacks, and this is achieved according to the invention by a cleaning head, wherein the rotation of the turbine is transferred to the gear in the gear housing via a hysteresis coupling comprising a magnetic inductor in the liquid space which is driven by the turbine, and which drives a hysteresis part which is mounted in the gear housing, and which is connected with the input shaft of the gear.

Such a hysteresis coupling provides for an unprecedented possibility of ensuring a quite certain torque transfer of the rotating movement at the start phase for cleaning heads for tanks. It has surprisingly been found that in spite of the great difference in the speed of rotation at the moment of start between the driving and the driven magnetic parts, the hysteresis coupling is capable of supplying a torque which is sufficiently great to accelerate the driven magnetic part and thereby the gear in terms of speed, if it is dimensioned correctly, that is that it can transfer a torque which is greater than the starting torque.

The advantageous properties of the hysteresis coupling include additionally that it is able to transfer an almost constant torque independently of the relative speed between the coupling parts, and that the coupling is able to operate with a continuous or varying slip, and that this slip is "soft" and has no detrimental effect on the structure.

In situations of slip, however, energy from the driving magnetic part accumulates in the material of the hysteresis part, because the poles in the hysteresis part constantly move at the passage of the poles of the inductor. This energy is transformed into heat, which is discharged to the surroundings via the pressure liquid.

When electromagnets are used as an inductor, it is possible to adjust the field strength and thereby to vary and control the slip and thus the transferred torque and/or the speed.

When permanent magnets are used as an inductor, it is possible to produce an inexpensive coupling which is maintenance-free, and which may be used inter alia in environments with inflammable and explosive vapours.

THE DRAWING

An example of an embodiment of a cleaning head according to the invention will be described more fully below with reference to the drawing, which shows a partially sectional view of a cleaning head.

DESCRIPTION OF AN EXEMPLARY EMBODIMENT

As shown in the drawing, the cleaning head comprises an inlet stub and a stationary part 6 to which a pipe (not shown) may be secured, and through which cleaning liquid may be supplied to the cleaning head.

The inlet channel 1 conveys the liquid through a stator 2 having guide plates to a turbine 3 having propellers, and both are mounted in the liquid space in the stationary part 6 of the cleaning head.

The turbine 3 is connected with the turbine shaft, which is connected with the driving inductor part 9 of the hysteresis coupling, which is also present in the liquid space.

The driving inductor part 9 is preferably composed of a plurality of electromagnets, which have the advantage that the magnetic field strength may be varied steplessly by changing the voltage. This provides the option of adjusting the slip and thereby the torque and/or the speed which it is desired to transfer via the coupling.

Instead of electromagnets, the inductor part 9 may be equipped with permanent magnets. This results in a coupling which, however, cannot be regulated, but which is easy and inexpensive to manufacture, and which is intended for use in tank cleaning systems which involve working with liquids that release vapours which are inflammable or explosive.

The gear housing 13 is mounted below the stationary part 6 such that liquid-wise the housing is separated by a partition 10 from the liquid space and the liquid flow in the channel 5, and, in the other words, that the gear is separated from the liquid.

The driven part 11 of the hysteresis coupling is mounted and secured to the input shaft 12 of the gear inside the gear housing 13. Preferably, the driven part 11 is made of a magnetic material containing metal oxides, such as $Fe_2O_3$ powder which is electrically insulating. This material has a high isotropic electrical resistance, which effectively prevents the generation of eddy currents in the hysteresis part. Further, the magnetic properties are good, even at relatively high temperatures.

Instead of this embodiment, it is conceivable to use a laminated material having layers of a ferromagnetic hysteresis material, which is insulated from each other by means of dielectric films.

The gear drives the gear housing 13 and the nozzle hub 15 to turn and rotate, respectively, so that, via the channels 4 and 5, the liquid may be conveyed to the nozzles 14 through channels 7 and flow out through nozzle openings 8.

If the inductive part 9 of the hysteresis coupling is provided with electromagnets, it is possible to regulate the slip by adjustment of the field strength and thereby the torque transferred by the coupling and/or the speed, which provides the desired turning and rotating movement.

Hereby a cleaning pattern may be achieved electronically, i.e. a control of the cleaning movements which allows for sections in the tank which are difficult to access, e.g. in that the speed is reduced in special zones to ensure cleaning of these zones.

If the inductor 9 of the hysteresis coupling is equipped with permanent magnets, a maintenance-free coupling is achieved, which is relatively inexpensive to manufacture, and which may be used in connection with inflammable and explosive liquids and vapours.

The invention claimed is:

1. A cleaning head for mounting inside a tank, said cleaning head comprising:

a turbine driven by a source of pressure liquid passing thereby for causing rotation thereof, a gear rotatably driven by said turbine, rotation of said gear causing a gear housing and a hub, mounted thereon and having nozzles, to rotate, said liquid being conveyed from the turbine to the nozzles without entering the gear housing, said gear housing being mounted on a stationary mounting part so that the liquid from the turbine bypasses the gear housing and flows to the nozzles, and a magnetic hysteresis coupling for magnetically transferring the rotation of the turbine to an input shaft of the gear, the magnetic hysteresis coupling having two coupling parts, a magnetic drive coupling part disposed outside the gear housing, and a driven hysteresis coupling part disposed inside the gear housing, a partition physically separating the magnetic drive coupling part, located outside the gear housing and within the flow of liquid flowing to the nozzles, from the driven hysteresis coupling part, located within the gear housing and out of contact with the liquid flow, rotation of the turbine (3) being transferred to the gear in the gear housing (13) via the magnetic hysteresis coupling which comprises a magnetic inductor drive coupling part (9) disposed in a liquid space in which the turbine (3) is driven, and being connected thereto and rotated thereby, the magnetic inductor drive coupling part (9) only magnetically engaging and driving the driven hysteresis coupling part (11) which is mounted in the gear housing (13), and which is connected with the input shaft (12) of the gear.

2. A cleaning head according to claim 1, characterized in that the magnetic inductor drive coupling part (9) is formed by electromagnets.

3. A cleaning head according to claim 2, characterized in that the magnetic inductor drive coupling part (9) has an adjustable magnetic field strength to adjust a torque or speed transferred from the magnetic inductor drive coupling part to the driven hysteresis coupling part.

4. A cleaning head according to claim 1, characterized in that the magnetic inductor drive coupling part (9) is formed by permanent magnets.

5. A cleaning head according to claim 1 wherein the driven hysteresis coupling part is made of a magnetic material containing metal oxides.

* * * * *